US006374708B1

(12) United States Patent
Kunz

(10) Patent No.: US 6,374,708 B1
(45) Date of Patent: Apr. 23, 2002

(54) TOOL FOR INSTALLING AND REMOVING WINTERIZING PLUGS

(76) Inventor: Cheryl Kunz, 650 Oak St., Suite 203, Norwood, NJ (US) 07648

( * ) Notice: Subject to any disclaimer, the term of this patent is extended or adjusted under 35 U.S.C. 154(b) by 0 days.

(21) Appl. No.: 09/848,304

(22) Filed: May 4, 2001

Related U.S. Application Data

(60) Provisional application No. 60/259,182, filed on Jan. 3, 2001.

(51) Int. Cl.[7] ..... B25B 13/00
(52) U.S. Cl. ..... 81/124.2; 81/124.3
(58) Field of Search ..... 81/124.2, 124.3, 81/124.6, 124.7, 177.5, 176.15, 176.2, 3.4

(56) References Cited

U.S. PATENT DOCUMENTS 3,086,414 A * 4/1963 Nardi ..... 81/176.1
3,151,512 A * 10/1964 Charczenko ..... 81/176.2
6,314,841 B1 * 11/2001 Burk et al. ..... 81/125.1

* cited by examiner

*Primary Examiner*—Joseph J. Hail, III
*Assistant Examiner*—David B. Thomas
(74) *Attorney, Agent, or Firm*—Rodger H. Flagg

(57) ABSTRACT

A tool is provided for installing and removing winterizing plugs located in drains, pools, boats, and other systems for providing protection from moisture during the winter season. Such plugs have threaded stems, and are typically secured by wingnuts. These plugs are then removed during warmer weather. In operation, the set screw is loosened to permit removal of the t-bar from the barrel. The t-bar is then inserted into a second transverse bore to serve as a handle for applying torque to selectively tighten and loosen the wingnut and to facilitate pulling the wingnut. The slotted end of the barrel is then slipped over the wingnut. Then, the wingnut can be easily tightened. This technique is also used when removing the plugs. The end of the tool is applied to a threaded portion of a winterizing plug above a wingnut for removal of the plug. The threaded portion of the winterizing plug extends well above the wingnut. The threaded portion of the passage engages the threaded portion of the winterizing plug.

20 Claims, 8 Drawing Sheets

TOOL FOR INSTALLING AND REMOVING WINTERIZING PLUGS

This application Claims Benefit to Provisional 60/259,182 filed Jan. 3, 2001.

FIELD OF THE INVENTION

The present invention relates to tools for installing and removing winterizing plugs or other plugs having a threaded stem. More particularly, the invention relates to tools for installing and removing winterizing plugs having a barrel and internal threaded bore for receiving a threaded stem. A tool pouch is provided for carrying the equipment needed for installing and removing winterizing plugs.

BACKGROUND OF THE INVENTION

Tools are known for removing threaded members. And, tools are known for tightening and removing wingnuts.

U.S. Pat. No. 4,905,547 to Nigrelli teaches a master key for wheel cover lock bolts or nuts. In this patent, a barrel has a removable cross piece for additional torque, and includes a mating shape for commercial lock bolts.

U.S. Pat. No. 1,397,876 to Meldal teaches a nut having a special top shape having four slots, together with a special tool. The special tool has a barrel shape and a handle, and its end has mating projections for engaging the four slots of the nut.

U.S. Pat. No. 6,044,732 to Astle teaches a plumbing tool. The tool has a shape conformed to engage a nut having a special top shape having a plurality of slots. The special tool has a barrel shape and a handle, and its end has mating projections for engaging the four slots of the nut.

U.S. Pat. No. 4,357,845 to Cornia teaches an apparatus for manipulating wingnuts. The tool has a wrench end and a tool-handle-engaging end. The wrench end has a hollow barrel portion with slotted sides to permit entry of wing portions of a wingnut.

SUMMARY OF THE INVENTION

From the foregoing, it is seen that it is a problem in the art to provide a device meeting the above requirements. According to the present invention, a device is provided which meets the aforementioned requirements and needs in the prior art. Specifically, the device according to the present invention provides a tool for installing and removing winterizing plugs having a barrel and threaded bore for receiving a threaded stem.

Winterizing plugs are used for drains, pools, boats, and other systems for providing protection from moisture during the winter season. Such plugs have threaded stems, and are typically secured by wingnuts. These plugs are then removed during warmer weather. However, such plugs take time to install, and may become very difficult to remove without stripping the threaded stems of the winterizing plugs.

Accordingly, it is desirable to provide a tool as shown in FIG. 1 for installing and removing winterizing plugs. The tool would also eliminate bruised fingers and scraped knuckles which would otherwise be experienced during manual installation and removal of such winterizing plugs.

The tool of the present invention has a t-bar mounted transversely to a barrel. The barrel has an upper end and a lower end. The barrel includes a relatively wide upper barrel portion, a relatively narrow lower barrel portion, and a transition portion joining the upper barrel portion and the lower barrel portion. The tool also includes a set screw. The upper barrel portion and the lower barrel portion both have circular cross sections, and the t-bar has a multi-sided cross section.

The barrel has a passage extending throughout the entire length of the barrel, and also includes a slot at the upper end. The t-bar has a knurled head portion, a body portion and a distal end portion. The upper barrel portion has a transverse bore for receiving the body portion of the t-bar. The passage has a diameter which is sufficiently large to receive the body portion of the t-bar.

Preferably, the lower portion of the passage is threaded, inside the lower barrel portion. When the tool is not in use, the t-bar is removed from the bore in the barrel, and inserted into the passage at the upper barrel portion of the barrel, for ease of storage. The threading is preferably ¼inch-20 UNC-2B threading, which corresponds to standard threading on typical plug stems. The length of the tool is preferably about 7 inches, and its diameter is preferably ⅞inches at the upper barrel portion, and its weight is about 4 ounces.

The t-bar is retained in place within the passage by the set screw. The set screw can be manually tightened and loosened. The set screw is mounted in conventional fashion so that it penetrates through the lower barrel portion 58 into the passage when fully tightened, so that it frictionally engages and retains the t-bar.

The present tool advantageously fits plugs of any size, and allows full, tight expansion of plugs. And, the tool can be used to remove plugs quickly and easily, as compared with conventional removal. The present tool can also be used with double plugs. It facilitates installation and removal even in hard-to-reach places like drains and skimmers. The present tool is preferably made of non-rusting material, such as aluminum. Stainless steel or other strong, non-rusting materials can also be used.

A tool kit includes the present tool, a custom tool pouch, a universal socket sized to fit with the present tool, at least one tap, a removal tool, a wingnut, a stud and an anchor extractor.

In operation, the present tool stores the t-bar handle within the barrel, providing for compact storage. To use the present tool, the set screw is loosened to permit removal of the t-bar from the barrel. The t-bar can then be inserted into the transverse bore to serve as a handle for applying torque to tighten or loosen the wingnut and to facilitate pulling if necessary. The slotted end of the barrel is then slipped over the wingnut. Then, the wingnut can be easily tightened. This technique is also used when removing the wingnut in preparation for removing the winterizing plugs.

The end of the present tool is applied to a threaded portion of a winterizing plug above the wingnut for removal of the plug. The threaded portion of the winterizing plug extends well above the wingnut. The threaded portion of the passage engages the threaded portion of the winterizing plug.

Other objects and advantages of the present invention will be more readily apparent from the following detailed description when read in conjunction with the accompanying drawings.

DETAILED DESCRIPTION OF THE INVENTION

Winterizing plugs are used for drains, pools, boats, and other systems for providing protection from moisture during the winter season. Such plugs have threaded stems, and are typically secured by wingnuts. These plugs are then removed during warmer weather. However, such plugs take time to install, and may become very difficult to remove without stripping the threaded stems of the winterizing plugs.

Accordingly, it is desirable to provide a tool 100 as shown in FIG. 1 through FIG. 8, for installing and removing winterizing plugs. The tool 100 would also eliminate bruised fingers and scraped knuckles which would otherwise be experienced during manual installation and removal of such winterizing plugs.

Figure 1:
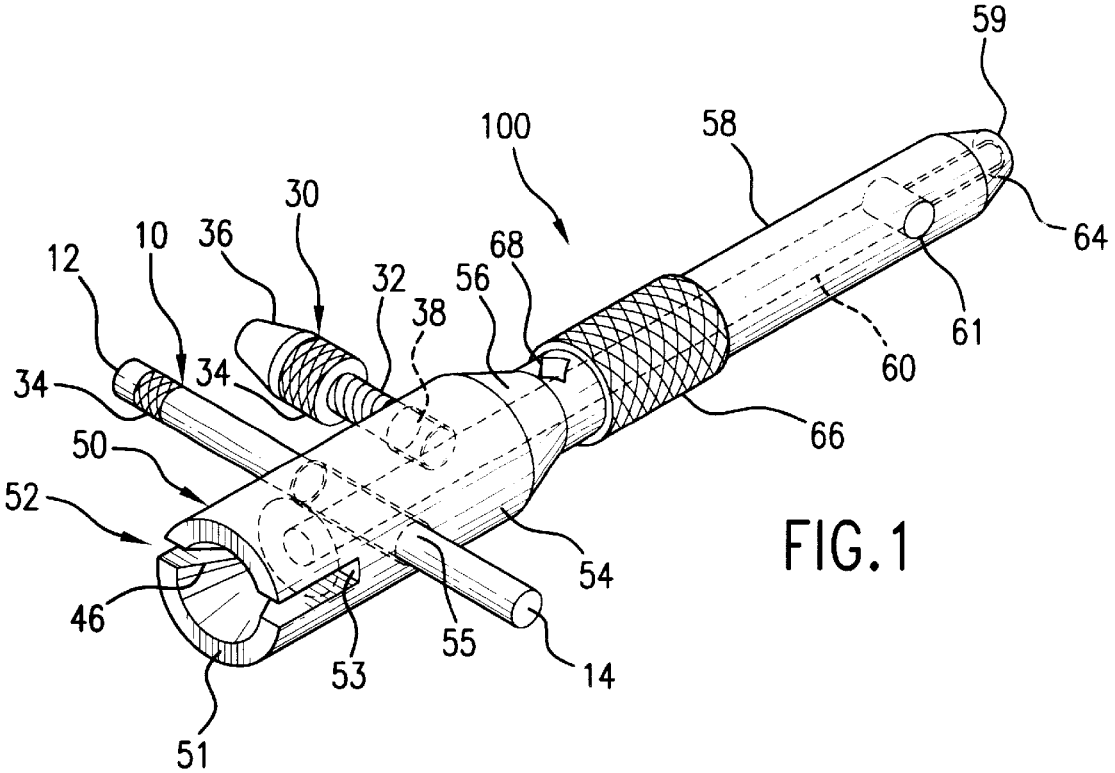
FIG. 1 is a perspective view of the winterizing plug tool with the T-bar installed transverse to the barrel, according to the present invention.

As shown in FIG. 1, the present tool 100 has a t-bar 10 mounted transversely to a barrel 50. The barrel 50 has an upper end 51 and a lower end 59. The barrel 50 includes a relatively wide upper barrel portion 54, a relatively narrow lower barrel portion 58, and a tapered transition portion 56 joining the upper barrel portion 54 and the lower barrel portion 58. The lower barrel portion 58 preferably has knurled grip portion 66, as shown in FIG. 1 through FIG. 8.

The upper barrel portion 54 and the lower barrel portion 58 each have transverse bores 55, 61 extending therethrough, and the t-bar 10 has a circular, hexagonal, or multi-sided cross section sized to be slidably received in either of the transverse bores 55, 61. The lower transverse bore 61 is preferably hexagonal in shape to slidably receive a hexagonal t-bar 10 therethrough.

A square aperture 68 extends through the lower barrel portion 58 between the tapered barrel portion 56 and the knurled grip portion 66. Preferably, the t-bar 10 is also slidably received in the square aperture 68.

The barrel 50 has a passage 60 extending substantially through the entire length of the barrel 50, with the portion adjacent to the lower end 59 threaded 62 to threadably receive the threaded portion 32 of the knurled set screw 30 therein.

Figure 7:
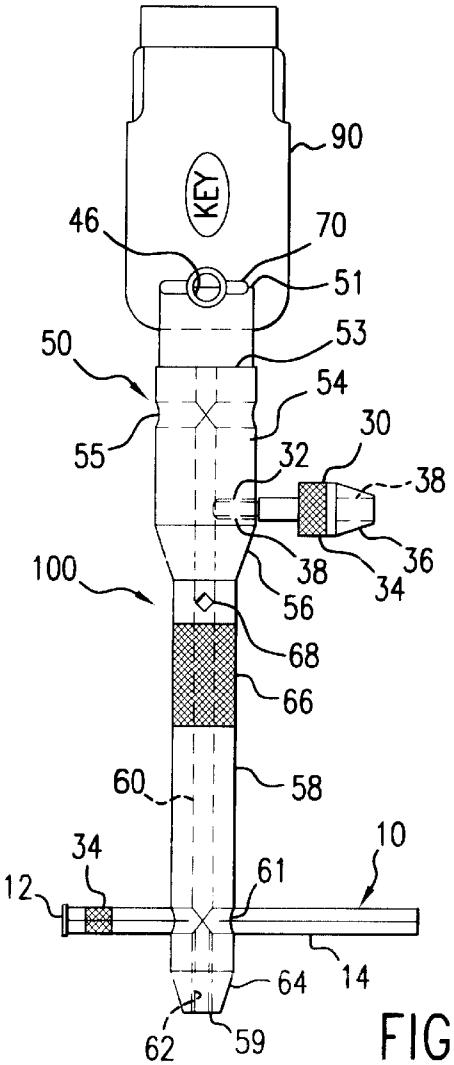
FIG. 7 is a side view of the winterizing plug tool positioned to install or remove all fittings and slotted plugs.

The barrel also includes a slot 52 at the upper end 51. The slot 52 preferably includes an internal tapered recess 46 sized to receive the side of a wingnut 70, as shown in FIG. 7.

The t-bar 10 has a head portion 12 and a body portion 14. The head portion 12 of the t-bar 10 is preferably knurled 34, as shown in FIG. 1, and FIG. 3 through FIG. 7. The lower end 14 of the head portion 12 of the t-bar is sized to be slidably received in the either the first transverse bore 55 or the second transverse bore located on the narrow lower barrel portion 58. The t-bar is also slidably received in the square aperture 68 provided. The t-bar 10 is also received in the axial aperture 60 located in the wide upper portion 54 of the barrel 50.

Figure 3:
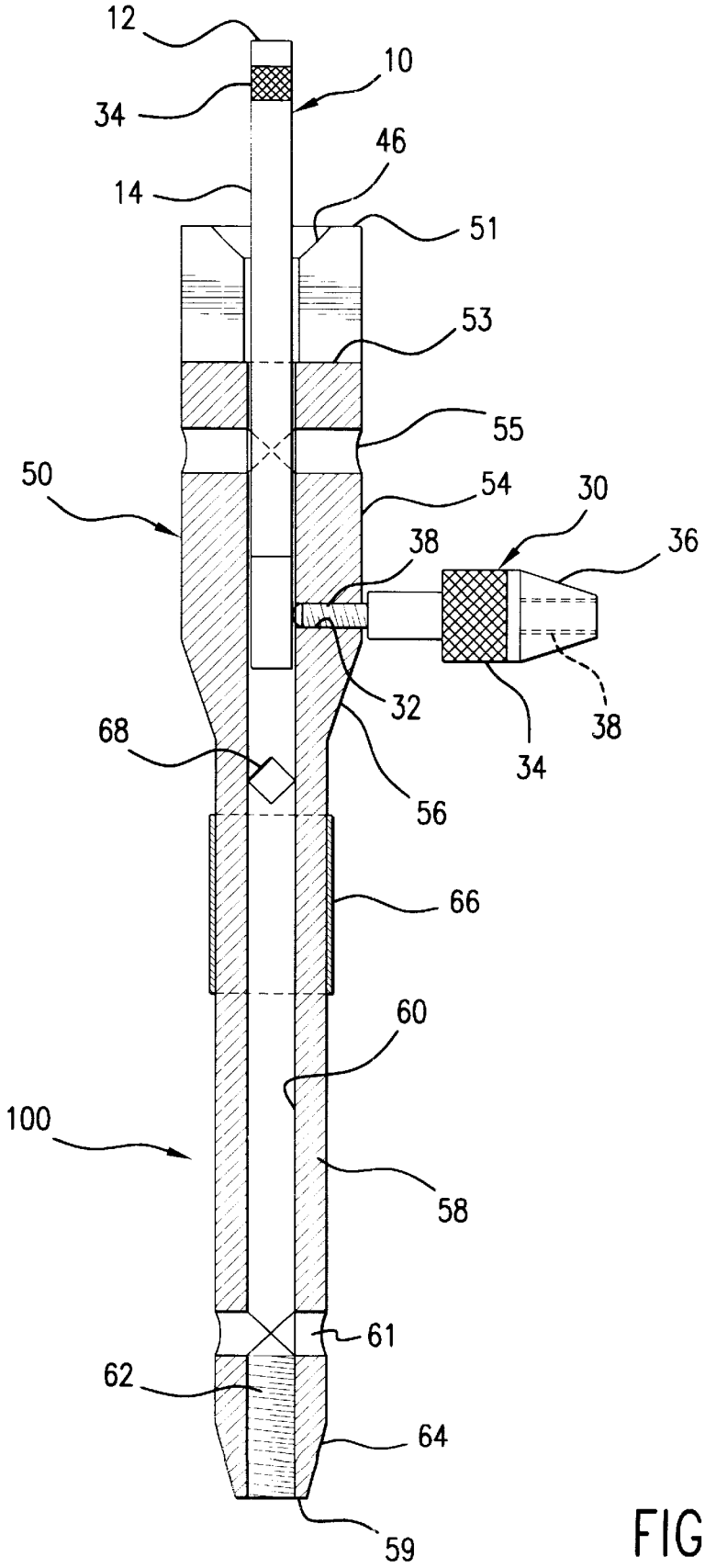
FIG. 3 is a cross-sectional view of the winterizing plug tool corresponding to FIG. 1, with a t-bar mounted inside the barrel portion of the tool, and showing the passages located inside of the barrel portion.

The upper barrel portion 54 has a first transverse bore 55, shown in FIG. 3, for receiving the body portion 14 of the t-bar 10. The axial passage 60 has a diameter which is sufficiently large to slidably receive the body portion 14 of the t-bar 10.

Preferably at least the lower portion of the passage 60 is threaded, inside the lower barrel portion 58. When not in use, the t-bar 10 is removed from the first transverse bore 55 in the barrel 50, and inserted into the axial passage 60 located in the upper barrel portion 54 of the barrel 50 (shown in FIG. 3). The threading is preferably ¼–20 inch threading, which corresponds to standard threading on most typical plug stems. The length of the present tool 100 is preferably about 7 inches, and its diameter is preferably ⅞inches at the upper barrel portion 54, and ⅝inches at the narrow lower barrel portion. The weight of the tool, including t-bar 10 and set screw 30 is preferably about 7 ounces, when the tool is made of aluminum.

The t-bar 10 is retained in place within the passage 60 by a set screw 30 having a threaded end 32, a knurled head portion 34 and a tapered end portion 36. The threaded end 32 of the set screw 30 is threadably received in an internal threaded portion 38 extending between one side of the upper barrel portion 54 and the axial passage 60. The set screw 30 can be manually tightened and loosened by rotating the threaded end 32 within the internal threaded portion 38. The set screw 30 is threadably received 32 within the internal threaded portion 38, so that it penetrates through the upper barrel portion 54 into the axial passage 60 when fully tightened, to frictionally engage and retain the t-bar 10 within the axial passage 60 during storage.

The tool 100 of FIG. 1 advantageously fits most winterizing plugs 70, and allows full, tight insertion and expansion of the plugs 70. The tool 100 can be used to remove or install winterizing plugs 70 quickly and easily, as compared with other conventional means of removal. The present tool 100 can also be used with double plugs. It facilitates installation and removal even in hard-to-reach places like drains and skimmers. The present tool 100 is preferably made of non-rusting material, such as aluminum. Stainless steel or other strong, non-rusting materials can also be used.

Figure 2:
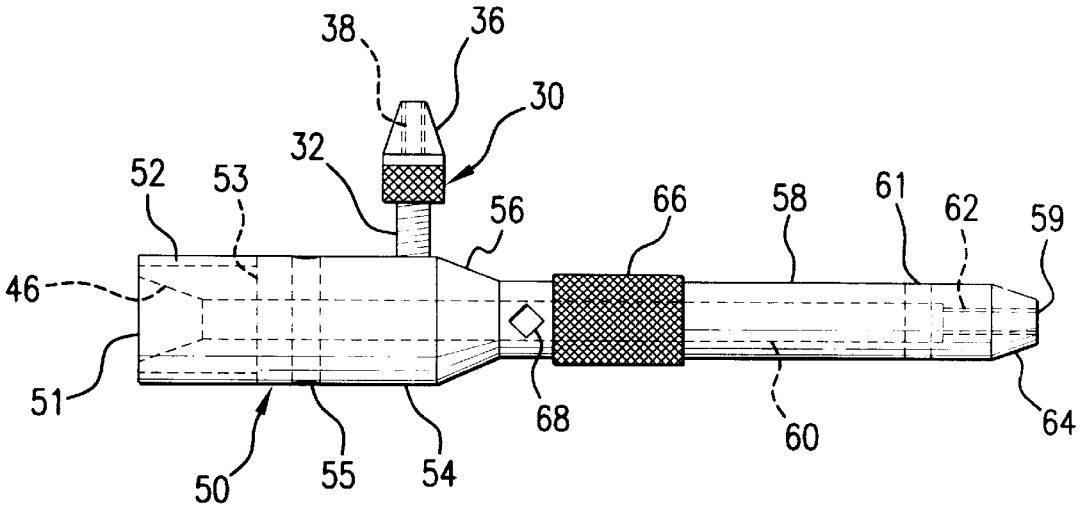
FIG. 2 is a side elevational view of the device of FIG. 1, with the T-bar handle removed.

FIG. 2 is a side elevational view of the present tool 100 shown in FIG. 1, as viewed from the left, with the t-bar 10 removed. In this view, the set screw 30 is clearly visible. The slot 52 is not visible in FIG. 2, but the bottom extent 53 of the slot 52 is shown in dashed outline in FIG. 2. The lower barrel portion 58 reveals the cross sectional shape of the lower barrel portion 58, and the threaded portion 62 of the passage 60.

FIG. 3 is a cross-sectional view of the present tool 100 similar to FIG. 1. In this view, the t-bar 10 is shown mounted inside the axial passage 60 extending through the upper barrel portion 54 of the tool 100. A second transverse bore 61 (also for receiving the t-bar 10) is shown extending through the lower barrel portion 58 of the barrel 50.

The first transverse bore 55 for receiving the t-bar 10 is shown in the upper barrel portion 54 of the barrel 50. Thus, the t-bar 10 is mounted in the second transverse bore 61 during insertion of winterizing plugs, and is mounted in the first transverse bore 55 during removal of the winterizing plugs. The T-bar is inserted within the axial passage 60 extending through the wide barrel portion 54 of the barrel 50, and held in place with the set screw 30 for ease of storage.

Figure 4:
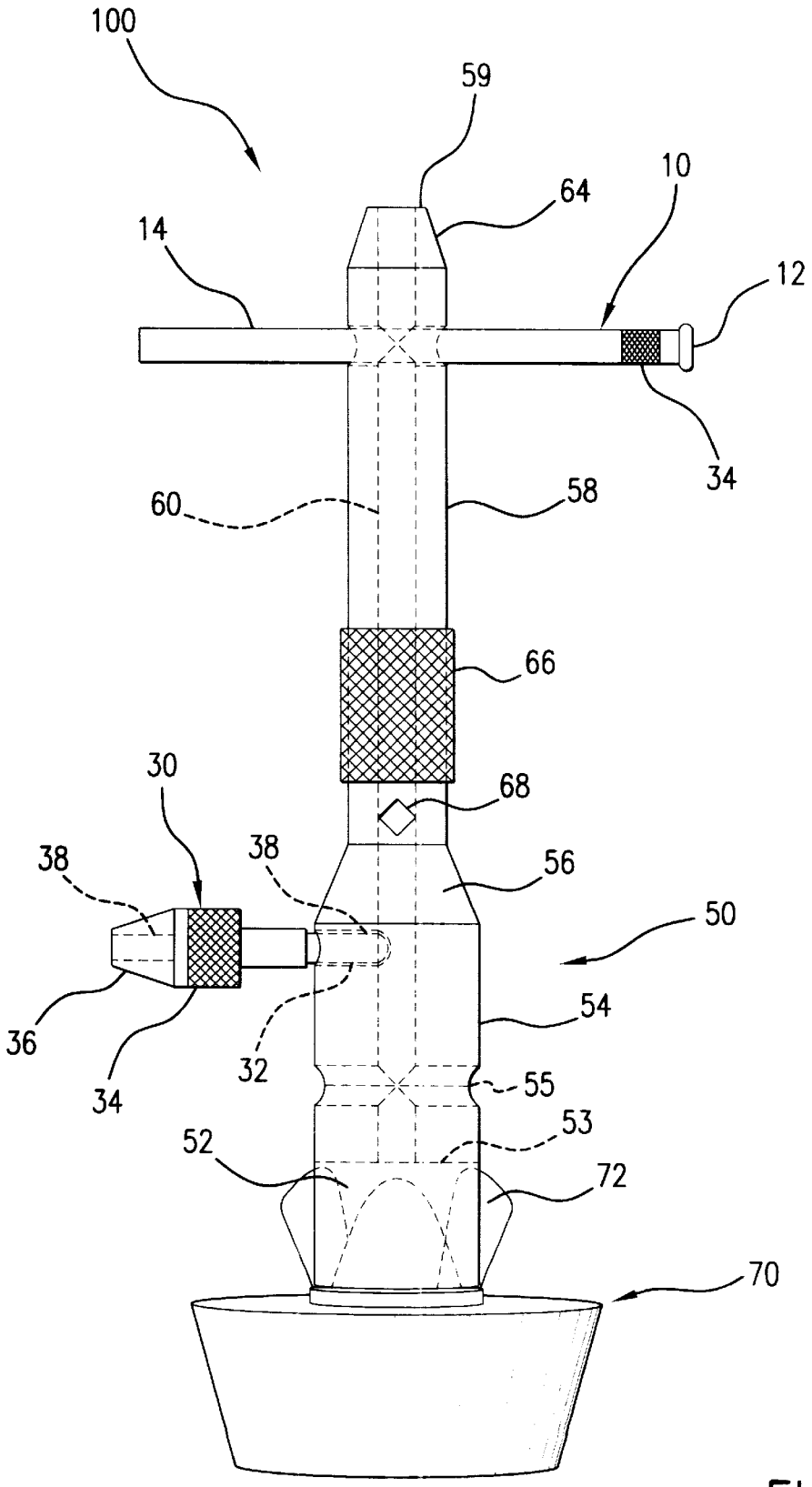
FIG. 4 is a front elevational view of the tool of FIG. 1 being applied to tighten a wingnut on a winterizing plug.

FIG. 4 is a perspective view of the tool 100 of FIGS. 1–3, shown being applied to tighten a wingnut 72 on a winterizing plug 70. This is the manner in which the winterizing plug 70 is installed using the present tool 100.

In FIG. 4, the slot 52 located in the upper end 51 of the barrel 50 enables the tool 100 to be placed over the wingnut 72 and to engage the wings thereof in a selective tightening or loosening operation. An internal tapered hole 46 provides clearance for the central body of the wingnut 72.

In operation, the set screw 30 is loosened to permit removal of the t-bar 10 from the barrel 50. The t-bar 10 can then be inserted into the second transverse bore 61 to serve as a handle for applying torque to tighten the wingnut 72, and to facilitate pulling if necessary. The slotted end 51 of the barrel 50 is then slipped over the wingnut 72. Then, the wingnut 72 can be easily tightened. This technique is also used when removing the plugs 70.

Figure 5:
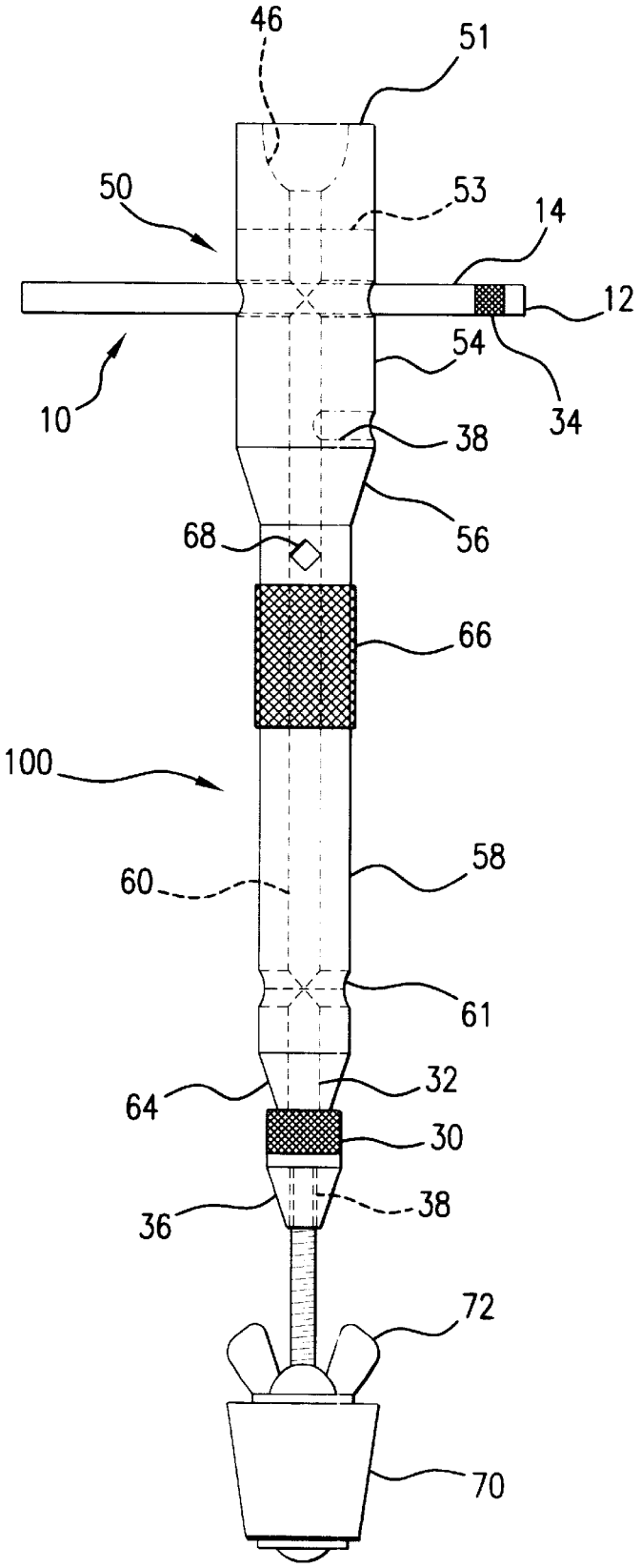
FIG. 5 is a front elevational view of the tool corresponding to FIG. 1 being applied to a threaded portion of a winterizing plug above a wingnut, for removal of the plug.

FIG. 5 is a front elevational view of the present tool 100 being applied to a threaded portion 74 of a winterizing plug 70 above a wingnut 72, for removal of the plug 70. As seen in FIG. 5, the threaded portion 74 of the winterizing plug 70 extends well above the wingnut 72. The threaded portion 62 of the passage 60 engages the threaded portion 32 of the set screw 30.

The set screw 30 has an internal threaded portion 38, which is sized to threadably receive the threaded portion 74 of the winterizing plug 70. Once the tool 100 has sufficiently threadably engaged the threaded portion 74 of the winterizing plug 70, the plug 70 may be easily pulled.

Figure 6:
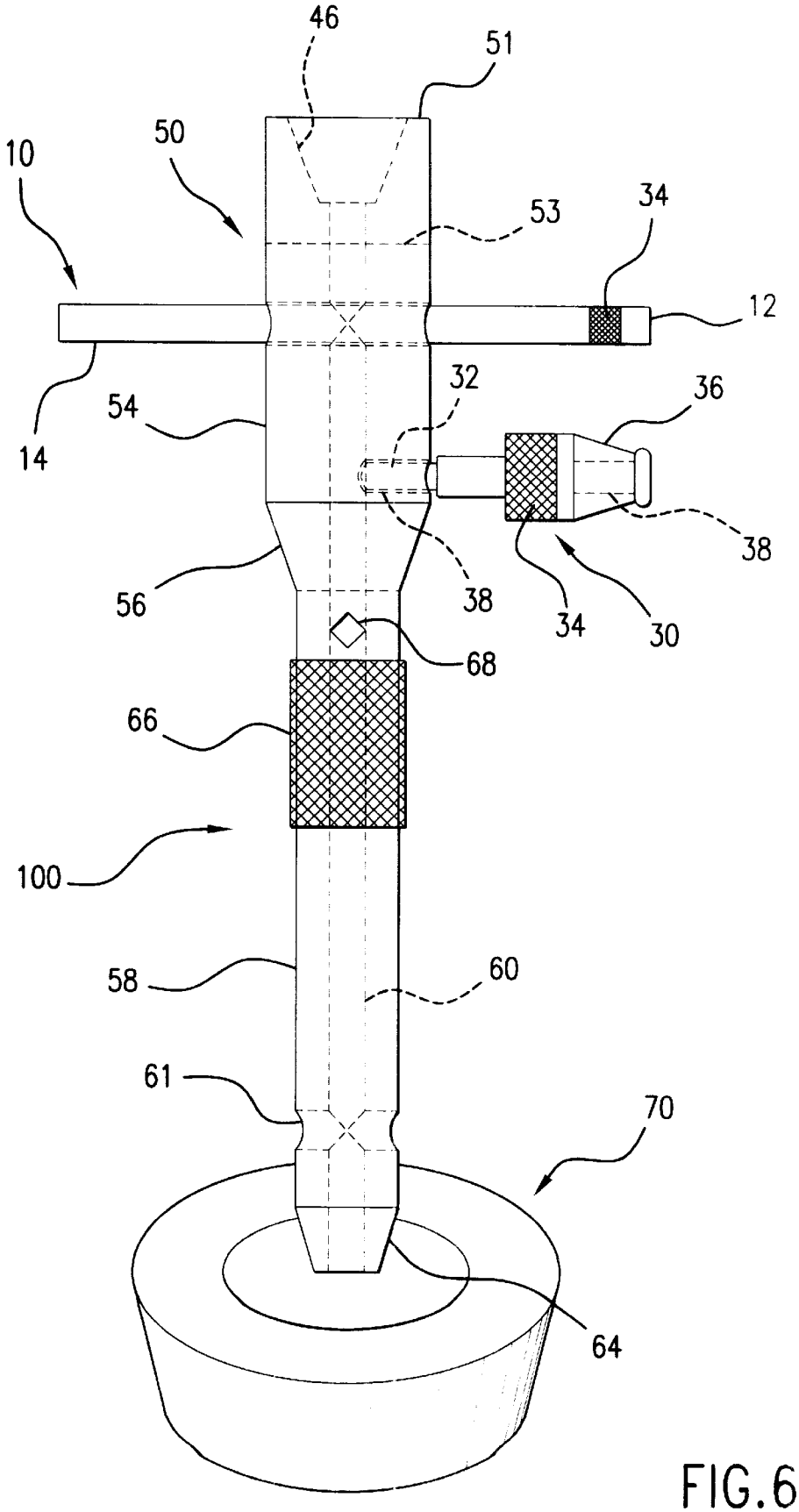
FIG. 6 is a front elevational view of the tool, corresponding to FIG. 1, being applied to a threaded portion of a winterizing plug in which the wingnut is not present, for removal of the plug.

FIG. 6 is a front elevational view of the present tool 100 being applied to a threaded portion 74 of the winterizing plug 70 in which the wingnut 72 is not present, for removal of the plug 70. This technique is used where the threaded portion 74 does not extend sufficiently far above the wingnut 72 to permit threaded engagement of the threaded portion 74 with the threaded portion of the passage 60. In this case, the wingnut 72 is removed, either manually or in the manner shown in FIG. 4.

FIG. 7 is a detail view of the present tool 100, when used in combination with the removal tool 90. The T-bar is inserted into the second transverse bore 61 to aid in manually turning the tool 100. The slotted upper end is placed against a wing nut, and the removal tool 90 is used to install and remove wall fitting, slotted plugs, flush plugs and three-way valves, as well as universal wall fittings.

Figure 8:
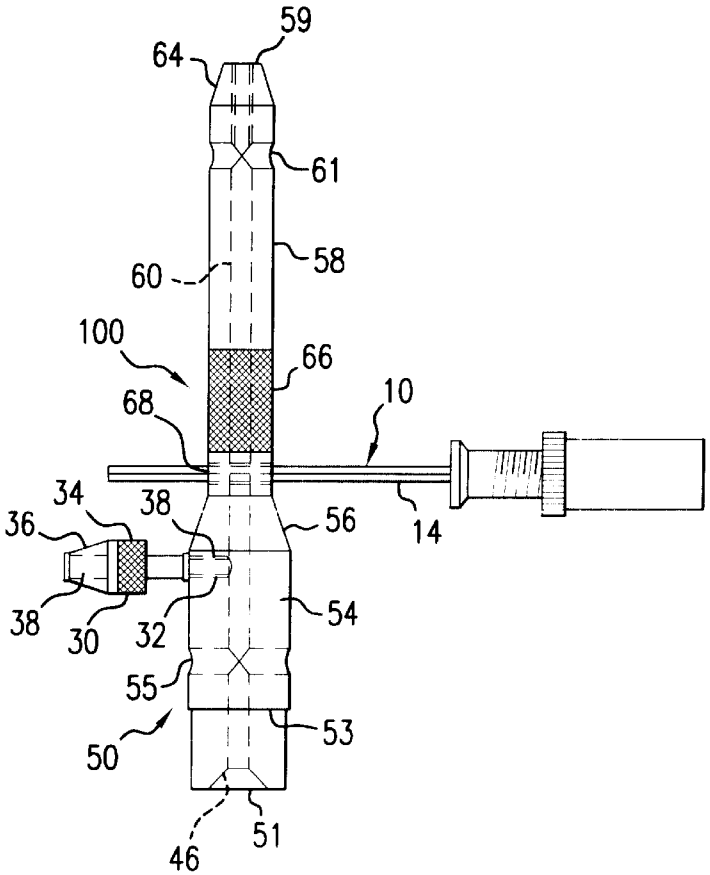
FIG. 8 is a side view of the winterizing plug tool positioned to raise or lower cover anchors.

FIG. 8 is a detail view of the present tool 100, when used to raise and lower safety cover anchors. This tool 100 works on all winter plugs and cover anchor sizes.

Figure 9:
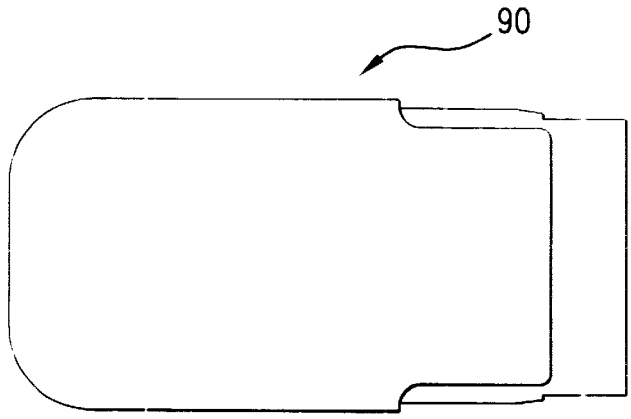
FIG. 9 is a side view of a removal tool.

FIG. 9 is a side view of the removal tool 90. The removal tool 90 is preferably made of aluminum, such as 2011 T3.

Figure 10:
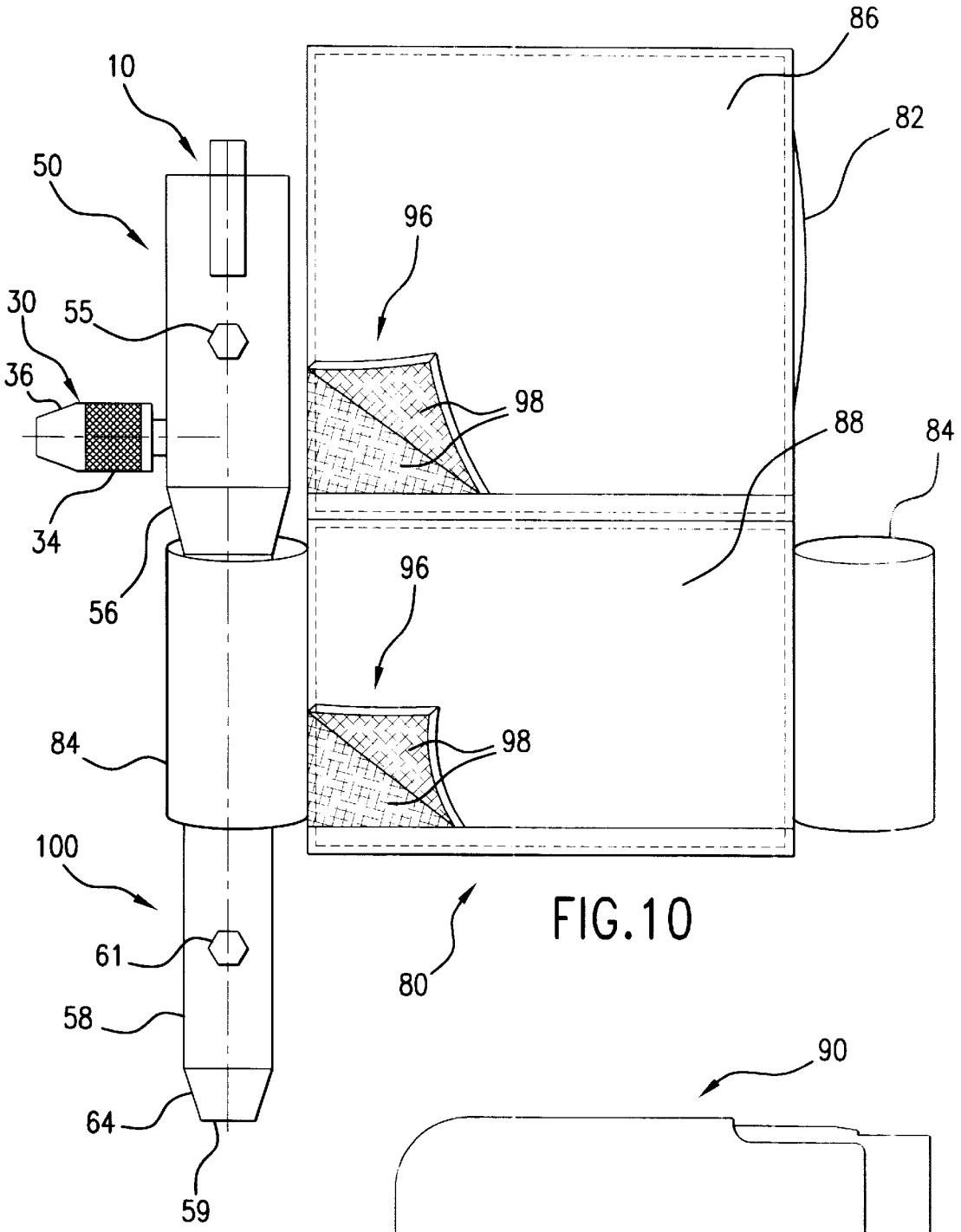
FIG. 10 is a tool kit having custom pouches for storing the present tools.

FIG. 10 is a front elevation view of the tool pouch 80, The tool pouch 80 includes a belt loop 82 to support the tool pouch 80 on a user's belt, and first and second tool holders 84 for carrying the present tool 100. The tool pouch 80 also includes a first pouch 86 which is preferably releasably secured 96 to retain the contents when not in use. The first pouch 86 preferably includes a universal socket, a first tap, such as a 5/16-18UNC-2A tap, a second tap, such as a 12-24UNC-2A tap, a removal tool 90, a wingnut 72, and a stud 94.

A second pouch 88 is located beneath the first pouch 86, and preferably contains an anchor extractor 92. The anchor extractor 92 preferably has a stud recess 78 sized to receive an existing anchor therein. A stud aperture 76 extends between the top portion of the anchor extractor 92 and the stud recess 78, and is sized to receive the stud 94 therethrough.

The first and second pouches 86, 88 are preferably releasably secured with hook and loop type fasteners 98. A individual tool holder 40 is preferably provided. The individual tool holder 40 has a belt loop 42 and a pocket 44 sized to receive the winterizing tool 100 therein.

Thus all the equipment needed to tighten and loosen winterizing plugs and test plugs, install and remove wall fittings, slotted plugs, flush plugs, and three-way valves and universal wall fittings, raise and lower safety cover anchors, tap thread into a cover anchor shell, remove old cover anchor shell from deck, and remove plugs from pipe, and hold plugs in place for vacuuming, are found in the tool pouch 80.

Figure 11:
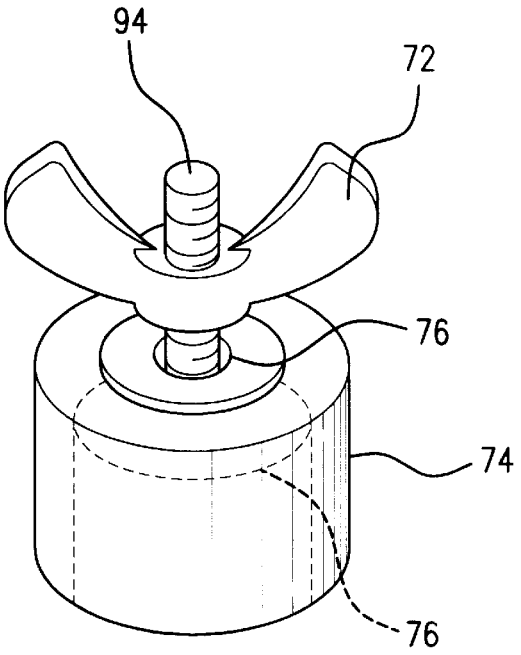
FIG. 11 is a perspective view of the extractor tool used to raise the anchor from a deck.

FIG. 11 is a perspective view of an extraction tool 74. A stud 94 is threaded into an existing anchor, after it has been tapped by a large tap in a ¼inch anchor hole, or by a small tap in a 3/16inch diameter anchor hole. The extraction tool 74 is then placed over an old anchor, with the stud 94 positioned to extend through the stud aperture 76. A wing nut 72 is then tightened with assistance from the t-bar 10, until the old anchor rises from the deck.

Figure 12:
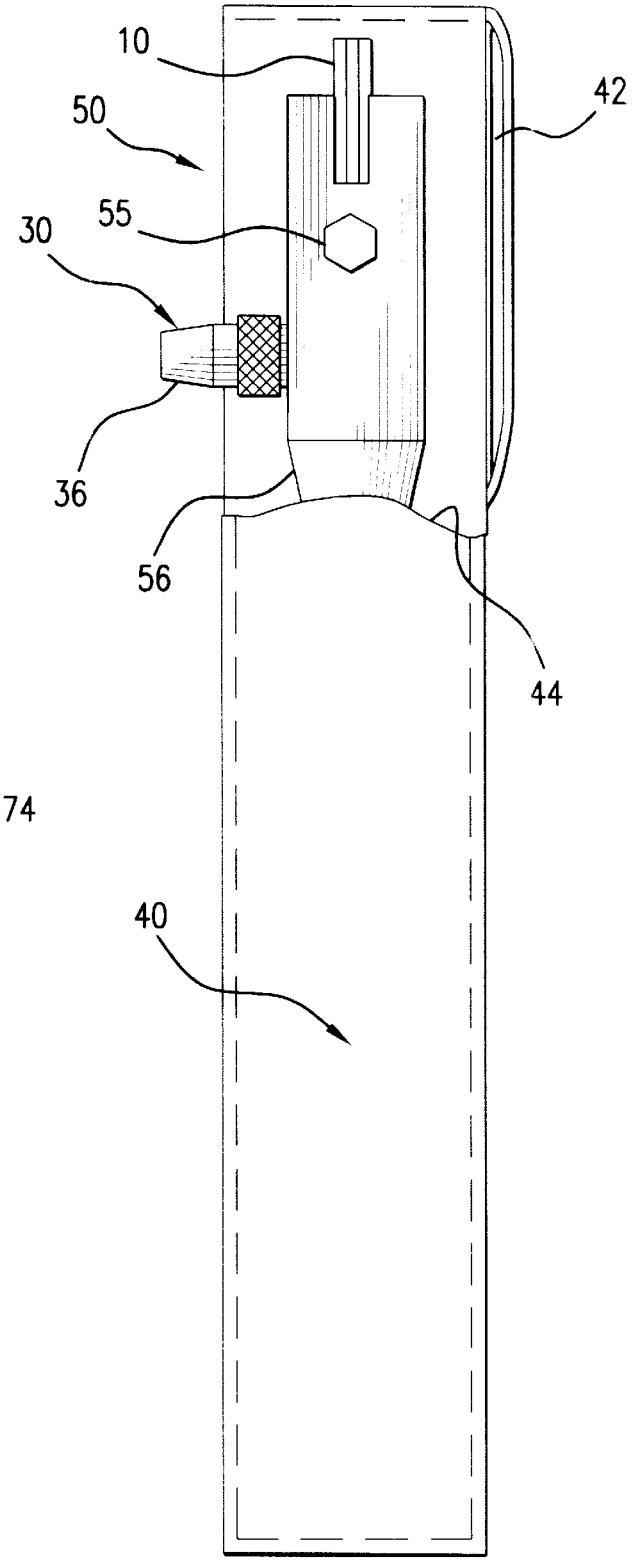
FIG. 12 is an individual tool holder having a belt loop and a pocket sized to hold the winterizing tool therein.

FIG. 12 is a perspective view of an individual tool holder 40 having a belt loop 42 and a pocket 44 sized to receive the winterizing tool therein. The individual tool holder may be used in addition to the tool holder 84, or when only the winterizing tool 100 is needed.

The invention being thus described, it will be evident that the same may be varied in many ways. Such variations are not to be regarded as a departure from the spirit and scope of the invention and all such modifications are intended to be included within the scope of the claims.

What is claimed is:

1. A winterizing tool apparatus for installing and removing winterizing plugs having a threaded stem, said winterizing tool apparatus comprising:

a) a tool body with a first wide upper barrel portion and a slotted upper distal end, a second narrow lower barrel portion with a tapered lower distal end, a tapered barrel portion extends between the upper barrel portion and the lower barrel portion, an axial passage extends the length of the tool body, the axial passage is threaded at the lower distal end and has an internal tapered recess at the upper distal end, a first transverse bore extends through the upper barrel portion in spaced relation below the slotted upper distal end of the upper barrel portion, a second transverse bore extends through the lower barrel portion in spaced relation above the tapered lower distal end and below the knurled grip portion, a square aperture extends through the lower barrel portion between the tapered barrel portion and the knurled grip portion, and an internal threaded portion extends between the upper barrel portion and the axial passage extending through the upper barrel portion, the internal threaded portion positioned in spaced relation between the first transverse bore and the tapered barrel portion;

b) a T-bar handle sized to be slidably received in a selected one of the first and second transverse bores to serve as a removable handle, said T-bar handle slidably received in said axial passage located within the upper barrel portion;

c) a removable set screw having external threads at a first end, and internal threads at a second tapered end, the set screw sized to be selectively threadably received in one of, the internal threaded portion of the upper barrel portion; and the distal end of the axial passage located in the threaded lower end of the lower barrel portion.

2. The winterizing tool apparatus of claim 1, wherein the cross sectional profile of the T-bar handle is hex-sided, and the external surface of the T-handle is enlarged near one end, and of a reduced cross-sectional size at the opposite end.

3. The winterizing tool apparatus of claim 1, wherein the set screw has a knurled head portion, and a tapered portion on a first end, with an internal threaded portion on the first end, the set screw also has an internal threaded portion on a second end, with a threaded rod threadably engaging the internal threaded portion on the second end, the threaded rod extending beyond the knurled head portion of the set screw.

4. The winterizing tool apparatus of claim 1, wherein a tool pouch has a belt loop, and a tool holster sized to carry and store the winterizing tool apparatus, the tool pouch has a first pouch sized to carry at least one universal socket, at least one tap, a removal tool, at least one wingnut, at least one stud, and a second pouch sized to carry an anchor extractor, and the first and second pouches are releasably secured together.

5. The winterizing tool apparatus of claim 1, wherein the T-bar handle is placed in the second transverse bore located in the lower barrel portion, the slotted upper end of the upper barrel portion is placed over an existing wing nut on an existing winterizing plug, and the T-handle is rotated to remove the existing wing nut.

6. The winterizing tool apparatus of claim 1, wherein the T-bar handle is alternately placed in the first transverse bore located in the upper barrel portion, and the external threaded portion of the threaded set screw is threadably received in the internal threaded axial portion of the lower barrel portion, and the external threads on a existing winterizing plug are threadably received in the internal threads of the threaded set screw, and the T-bar handle is rotated to remove the existing winterizing plug.

7. The winterizing tool apparatus of claim 1, wherein the lower barrel portion has a knurled grip portion located in spaced relation below the tapered barrel portion and above the second transverse bore.

8. A winterizing tool apparatus for installing and removing winterizing plugs having a threaded stem, said winterizing tool apparatus comprising:

a) a tool body, having a first wide upper barrel portion with a slotted upper distal end, and a second narrow lower barrel portion with a tapered lower distal end, a tapered barrel portion extends between the upper barrel portion and the lower barrel portion, the lower barrel portion having a knurled grip portion located in spaced relation below the tapered barrel portion, an axial passage extends the length of the tool body, the axial passage is threaded at the lower distal end and has an internal tapered recess at the upper distal end, a first transverse bore extends through the upper barrel portion in spaced relation below the slotted upper distal end of the upper barrel portion, a second transverse bore extends through the lower barrel portion in spaced relation above the tapered lower distal end and below the knurled grip portion, a square aperture extends through the narrow lower barrel portion between the tapered barrel portion and the knurled grip portion, and an internal threaded portion extends between the upper barrel portion and the axial passage extending through the upper barrel portion, the internal threaded portion positioned in spaced relation between the first transverse bore and the tapered barrel portion;

b) a T-bar handle is sized to be slidably received in a selected one of the first and second transverse bores to serve as a removable handle, said T-bar handle further slidably received in said axial passage located within the upper barrel portion;

c) a set screw has external threads at a first end, and internal threads at a second tapered end, the set screw sized to be selectively threadably received in one of, the internal threaded portion of the upper barrel portion; and the distal end of the axial passage located in the threaded lower end of the lower barrel portion.

9. The winterizing tool apparatus of claim 8, wherein the cross sectional profile of the T-bar handle is multi-sided, and the external surface of the T-bar handle is knurled near one end.

10. The winterizing tool apparatus of claim 8, wherein the set screw has a knurled head portion, and an unthreaded boss extends between the knurled head portion and the external threaded portion of the set screw.

11. The winterizing tool apparatus of claim 8, wherein a tool pouch with a belt loop, and a tool holder sized to carry and store the winterizing tool apparatus, the tool holder comprises a first pouch sized to carry at least one universal socket, at least one tap, a removal tool, at least one wing nut, and at least one stud, and a second pouch is sized to carry an anchor extractor, and the first and second pouch are each releasably secured with hook and loop type fasteners.

12. The winterizing tool apparatus of claim 8, wherein the T-bar handle is placed in the second transverse bore located in the lower barrel portion, the slotted upper end of the upper barrel portion is placed over an existing wing nut on an existing winterizing plug, and the T-bar handle is rotated to remove the existing wing nut.

13. The winterizing tool apparatus of claim 8, wherein the T-bar handle is alternately placed in the first transverse bore located in the upper barrel portion, and the external threaded portion of the threaded set screw is threadably received in the internal threaded axial portion of the lower barrel portion, and the external threads on a existing winterizing plug are threadably received in the internal threads of the threaded set screw, and the T-bar handle is rotated to remove the existing winterizing plug.

14. The winterizing tool apparatus of claim 8, wherein the lower barrel portion has a knurled grip portion located in spaced relation below the tapered barrel portion and above the second transverse bore.

15. A winterizing tool apparatus for installing and removing winterizing plugs having a threaded stem, said winterizing tool apparatus comprising:

a) a tool body, having a first wide upper barrel portion with a slotted upper distal end, and a second narrow lower barrel portion with a tapered lower distal end, a tapered barrel portion extends between the upper barrel portion and the lower barrel portion, the lower barrel portion having a knurled grip portion located in spaced relation below the tapered barrel portion, an axial passage extends the length of the tool body, the axial passage is threaded at the lower distal end and has an internal tapered recess at the upper distal end, a first transverse bore extends through the upper barrel portion in spaced relation below the slotted upper distal end of the upper barrel portion, a second transverse bore extends through the lower barrel portion in spaced relation above the tapered lower distal end and below the knurled grip portion, a square aperture extends through the narrow lower barrel portion between the tapered barrel portion and the knurled grip portion, and an internal threaded portion extends between the upper barrel portion and the axial passage extending through the upper barrel portion, the internal threaded portion positioned in spaced relation between the first transverse bore and the tapered barrel portion;

b) a T-bar handle is sized to be slidably received in a selected one of the first and second transverse bores and the square aperture to serve as a removable handle, said T-bar handle further slidably received in said axial passage located within the upper barrel portion, the cross sectional profile of the T-bar handle is multi-sided, and the external surface of the T-bar handle is knurled near one end; and c) a knurled set screw has external threads at a first end, and internal threads at a second tapered end, the knurled set screw sized to be selectively threadably received in one of, the internal threaded portion of the upper barrel portion; and the distal end of the axial passage located in the threaded lower end of the lower barrel portion.

16. The winterizing tool apparatus of claim 15, wherein the set screw has a knurled head portion, and an unthreaded boss extends between the knurled head portion and the external threaded portion of the set screw.

17. The winterizing tool apparatus of claim 15, wherein a tool pouch has a belt loop, and at least one tool holder for carrying the winterizing tool apparatus, the tool pouch has a first pouch sized to carry and store at least one universal socket, at least one tap, a removal tool, at least one wingnut, and at least one stud, and a second pouch is sized to carry an anchor extractor therein, and the first and second pouches are each releasably secured with hook and loop type fasteners.

18. The winterizing tool apparatus of claim 15, wherein the T-bar handle is placed in the second transverse bore located in the lower barrel portion, the slotted upper end of the upper barrel portion is placed over an existing wing nut on an existing winterizing plug, and the T-bar handle is rotated to remove the existing wing nut.

19. The winterizing tool apparatus of claim 15, wherein the T-bar handle is alternately placed in the first transverse bore located in the upper barrel portion, and the external threaded portion of the threaded set screw is threadably received in the internal threaded axial portion of the lower barrel portion, and the external threads on a existing winterizing plug are threadably received in the internal threads of the threaded set screw, and the T-bar handle is rotated to remove the existing winterizing plug.

20. The winterizing tool apparatus of claim 15, wherein the lower barrel portion has a knurled grip portion located in spaced relation below the tapered barrel portion and above the second transverse bore.

* * * * *